US005676196A

United States Patent [19]

Jakubzick et al.

[11] Patent Number: 5,676,196

[45] Date of Patent: Oct. 14, 1997

[54] DUAL ENERGY SAVER FOR AIR CONDITIONING

[75] Inventors: Marcelo E. Jakubzick; Luis F. Noriega, both of Miami, Fla.

[73] Assignee: M.G. General Corporation, Miami, Fla.

[21] Appl. No.: 502,342

[22] Filed: Jul. 14, 1995

[51] Int. Cl.[6] ..... F25B 29/00

[52] U.S. Cl. ..... 165/11.1; 165/270; 165/247; 55/274; 236/11; 236/94; 62/158; 62/182; 62/186

[58] Field of Search ..... 165/11.9, 11.1, 165/270, 247; 55/272, 274; 236/11, 47, 94; 62/138, 182, 186

[56] References Cited

U.S. PATENT DOCUMENTS

| | | | |
|---|---|---|---|
| 4,002,292 | 1/1977 | Parks | 236/47 |
| 4,014,499 | 3/1977 | Hamilton | 236/47 |
| 4,136,730 | 1/1979 | Kinsey | 165/12 |
| 4,369,916 | 1/1983 | Abbey | 236/11 |
| 4,773,587 | 9/1988 | Lipman | 236/11 |
| 4,842,044 | 6/1989 | Flanders et al. | 236/11 |
| 5,142,880 | 9/1992 | Bellis | 62/182 |
| 5,236,477 | 8/1993 | Koketsu | 55/274 |
| 5,582,233 | 12/1996 | Noto | 236/11 |

FOREIGN PATENT DOCUMENTS

| | | | |
|---|---|---|---|
| 60-147211 | 8/1985 | Japan | 55/274 |
| 62-194143 | 8/1987 | Japan | 55/274 |

OTHER PUBLICATIONS

EcoGuard Permanent Electrostatic Air Filters Brochure (No date).

Hunter Programmable Themostats Brochure (1993).

*Primary Examiner*—John K. Ford

[57] ABSTRACT

An attachment unit (28) to an existing central air conditioning thermostat controller (24) like the ones found in most homes and offices; which provides two independent modes of saving energy, first by turning on a light to indicate when to change the filter and secondly by extending the fan operation for a few minutes without disruption. Uniquely conceived, smaller than the typical thermostat controller, automatic, maintenance free, no batteries or auxiliary power of any kind. Has one button (32) to reset the light (30) after changing the filter and one switch (34) to select the optional extended fan operation.

1 Claim, 3 Drawing Sheets

DUAL ENERGY SAVER FOR AIR CONDITIONING

BACKGROUND

1. Field of Invention

This invention relates to central air conditioning systems, specifically to an automatic energy saving attachment to existing low-voltage thermostat controllers for said systems.

2. Description of Prior Art

A central air conditioning system such as those found in most homes and offices have a thermostat controller to set the temperature and to select cool or hot operation. Said thermostat then automatically and simultaneously turns on or off the fan and compressor relays or the fan and heat relays depending on the selection, thus achieving a room temperature around the selected value. In said system, there is also an air filter that should be changed every few months.

Previous energy improvements to said system that relates to our invention can be categorized into two groups:

First group proposes to save energy by extending the duty cycle of the fan to recover some cold or heat energy stored in the ducts and radiator mass. The savings are possible because the fan uses a fraction of the cold or heat energies. Several implementations of this principle have been proposed; for example U.S. Pat. Nos. 5,142,880 to Bellis (1992), 4,369,916 to Abbey (1983), 4,136,730 to Kinsey (1979).

Second group proposes a savings by indicating when to change the filter. However, to the best of our knowledge, this technology exists in high priced electronic thermostat controllers and in whistling filters, we have not seen a proposed attachment to existing thermostat controllers that includes this second group. Said electronic thermostat controllers have a liquid crystal display that depicts the amount of time the air conditioner was operational, thus indicating after several hours that it is time to change the filter. Said whistling filters produce a sound when dirty thereby signaling when the filter needs replacing.

Below are some disadvantages of the corresponding groups.

First Group:

(a) Previous patents treat the change in relative humidity as negligible. This treatment is only valid in low humidity regions. Relative humidities greater than 50% renders the whole concept inoperative; there are no savings if the user has to lower the temperature to obtain the same comfort level. In these cases, the extended fan operation does not work as intended and needs to be disabled, simply and quickly.

(b) Previous patent units can not be easily disabled for repairs or maintenance of said central air system.

(c) Previous patents have a momentary period when the fan turns off simultaneously with the compressor. This is part of the normal operation because the compressor needs to be off in order for the patented apparatus to become energized and thereby extend the operation of the fan. This results in an unnecessary on/off period for the fan that will cause annoyance to the user and objections to the warranty from a manufacturer of air conditioning systems that is informed on how their parts are used, since the fan would be used to cycle twice more frequently than intended by design.

(d) Previous patents do not properly cover the event of an imperceptible power-down. This results in the unwarranted activation of the fan, thus creating consumer annoyance.

Second Group:

(e) Electronic thermostats that indicate when to change the filter requires batteries, maintenance, and the unwanted expensive replacement of the existing thermostat. Some electronic thermostats use very large capacitors instead of batteries, however they will discharge after a period of time.

(f) Once programmed, electronic thermostats are seldom looked at. This common tendency prevents noticing when to change the filter when it is displayed on the LCD.

(g) Whistle filters are very expensive and hard to find.

Objects and Advantages

When we conceptualized the idea, we incorporated both groups in a single apparatus and with new and improved features not found in any group. The next step was to devise an apparatus and method to accurately test the results. This consisted of rigorous testing through a custom designed data acquisition computer that compiled measurements of outside temperature, inside temperature, relative humidity, and times of operation at a rate of 120,000 per day. The description of the computer and test procedure lies beyond the scope of this patent; nevertheless the results are as follows:

Savings of 10% can be obtained by extending the fan operation in a Cool setting of the central air conditioning.

Savings of 20% can be obtained by indicating when to change the filter in a Cool or Hot setting.

While keeping the same temperature, when room ambient relative humidities are above 50%, a 4% increase due to the extended fan operation is significantly noticeable, especially at night.

The invention, henceforth known as "the unit", accomplishes the energy savings of each group previously discussed with new features and a novel approach. The unit is a small electronic circuit board that attaches adjacent to an existing thermostat without disruption. It automatically indicates when to change the filter and optionally provides extended operation of the fan.

Several objects and advantages of the present invention are:

(a) In areas or seasons where ambient relative humidity is higher than 50%, the unit provides a simple disable switch for the extended fan operation. This same switch is used to disable the unit when maintenance or repair is needed on the central air conditioning system the unit is attached to. This switch does not affect the bigger savings obtained by knowing when to change the filter.

(b) The unit may be disabled with a simple switch.

(c) The unit permits the fan to continue operating without having to momentarily shut off when the compressor shuts off. This provides an uninterrupted operation eliminating annoyances, warranty objections and premature failure. The unit accomplishes this by getting its power from dual sources within existing connections.

(d) Smooth transitions in all operations are obtained. This eliminates unwanted on/off cycles of the fan due to imperceptible power downs or other normal requirements. This is achieved due to the intelligent nature of a microprocessor that controls the unit.

(e) Maintenance free, there are no batteries or adjustments to make. Also the unit easily attaches to the user's preferred existing thermostat. We found 50% of people prefer the simple mechanical thermostats found in most homes and offices because they are simpler to change the temperature; the people we asked would not change to an electronic thermostat even if its free.

(f) A single blinking light is a very noticeable and simple way to indicate when to change the filter; first attachment that does this as far as we know.

(g) Regular low cost filters can be used and a user will know when to change the filter, thus saving more than 20% in energy by having a clean filter all the time.

In addition the price of the unit is inexpensive and pays for itself typically with three months of savings. Installation of the unit can be made in a few minutes and will last a lifetime.

DRAWING FIGURES

Reference Numerals In Drawings

Figure 1:
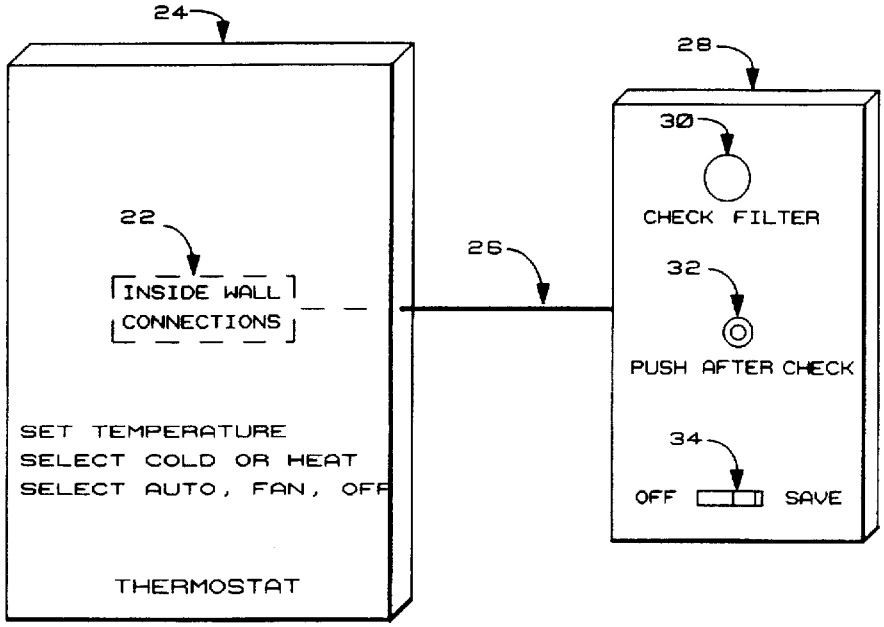
FIG. 1 shows a physical distribution of the unit with an existing thermostat and wall connections to a central air conditioning system.

22 an air conditioning system portion that interfaces electrically with the unit and an existing thermostat controller

24 an existing thermostat, found in most homes and offices, to control the operation of an air conditioning system.

26 four cables connecting the unit 28 to portion 22 and thermostat 24

28 the unit, the preferred embodiment of our invention

30 light emitting diode, LED, of the unit 28

32 momentary push button to reset light 30 of the unit 28

34 single throw, single pole switch to disable extended fan operation of the unit 28, in the SAVE position it is closed

36 one primary input of transformer 40

38 the other primary input of transformer 40

40 control transformer, part of portion 22

42 secondary side of transformer 40 used as ground by the unit 28; this point is also marked R for red wire and constitutes a power terminal, one of four connecting points to an existing thermostat 24

44 secondary side of transformer 40, common point to all portion 22 relays

46 compressor relay side where power control takes effect; this point is also marked Y for yellow wire and constitutes a compressor relay terminal, one of four connecting points to an existing thermostat 24

48 heater relay side where power control takes effect; this point is also marked W for white wire and constitutes a heater relay terminal, one of four connecting points to an existing thermostat 24

50 fan relay side where power control takes effect; this point is also marked G for green wire and constitutes a fan relay terminal, one of four connecting points to an existing thermostat 24

52 signal ground of the unit 28, protected by low current fuse

54 positive 15 volts direct current voltage of the unit 28 with respect to signal ground 52

56 positive 5 volts direct current voltage of the unit 28 with respect to signal ground 52

58 monitor voltage for the unit 28 with respect to signal ground; it indicates voltages 54 and 56 are properly energized

60 power supply for the unit 28

62 microprocessor output voltage to turn on and off LED 30

64 microprocessor system for the unit 28

66 microprocessor input to sense switch 32

68 microprocessor output, positive logic to turn on the fan driver 76

70 microprocessor output, negative logic to turn on the fan driver 76

72 fan driver output to close or open TRIAC switch 74

74 TRIAC is an electronic integrated circuit switch used to turn on or off the fan relay at point 50 if regular switch 34 is closed

76 fan driver controlled by microprocessor 64 produces a single output 72

78 electrical point of union between switch 34 and TRIAC 74

80 power ground for TRIAC 74, protected by high current fuse

Figure 5:
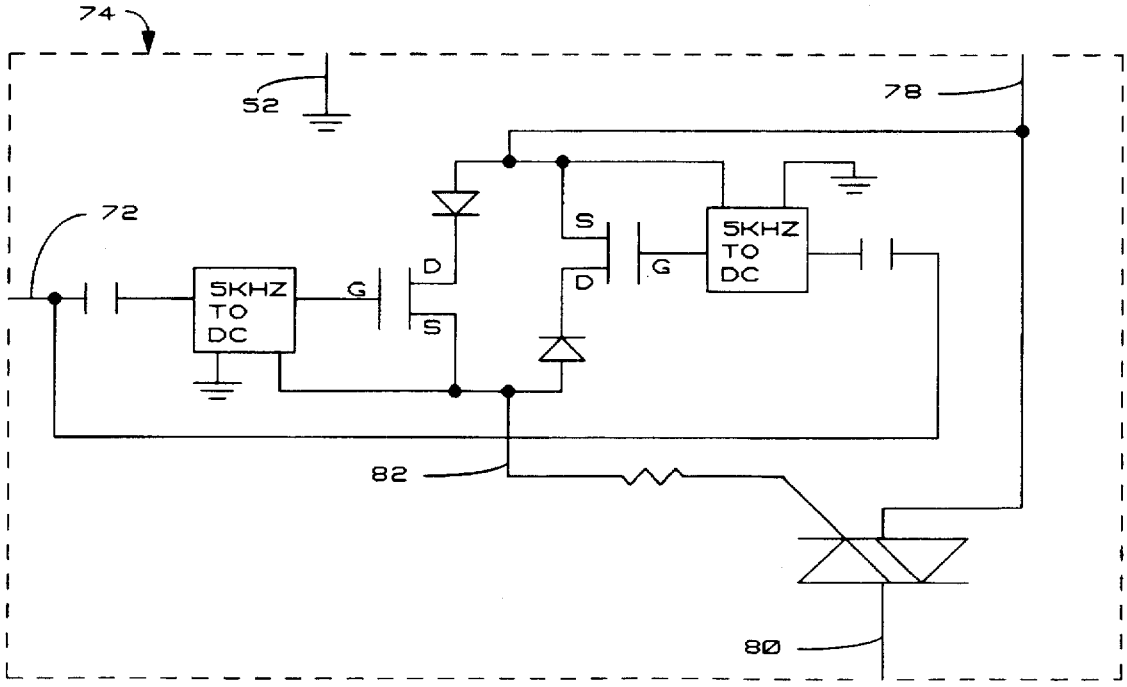
FIG. 5 shows the block circuit of TRIAC SW, part of the unit.

82 alternate point for power ground in TRIAC 74 when resistor and TRIAC are removed in FIG. 5

DESCRIPTION—FIGS. 1 TO 5

These descriptions of the preferred embodiment of our invention are for the purposes of illustration, but not of limitation, in connection with the accompanied figures in which like numbers refer to like parts throughout.

Typical installation:

The unit 28 in FIG. 1 connects to the existing thermostat 24 controller via cables 26 at the points where the thermostat 24 had a connection to the air conditioning system 22. These connections are in parallel as shown on FIG. 2, having common points at 42, 46, 48 and 50.

Unit 28 size and consumption:

The unit as described here has approximately 3.1 inches in length by 1.8 inches in width by 0.4 inches in height. Most of the components used are surface mount package technology.

The current flowing thru the unit is less than 1 milliamp with the LED off and less than 3 milliamps when LED is turned on. The voltage across the unit is 24 alternating current volts (VAC) nominal, making the power consumption less than 0.024 watts with LED off; in other words, the amount of energy saved in one typical day is equivalent to the total energy consumption of the unit 28 for the next 12 years.

Figure 2:
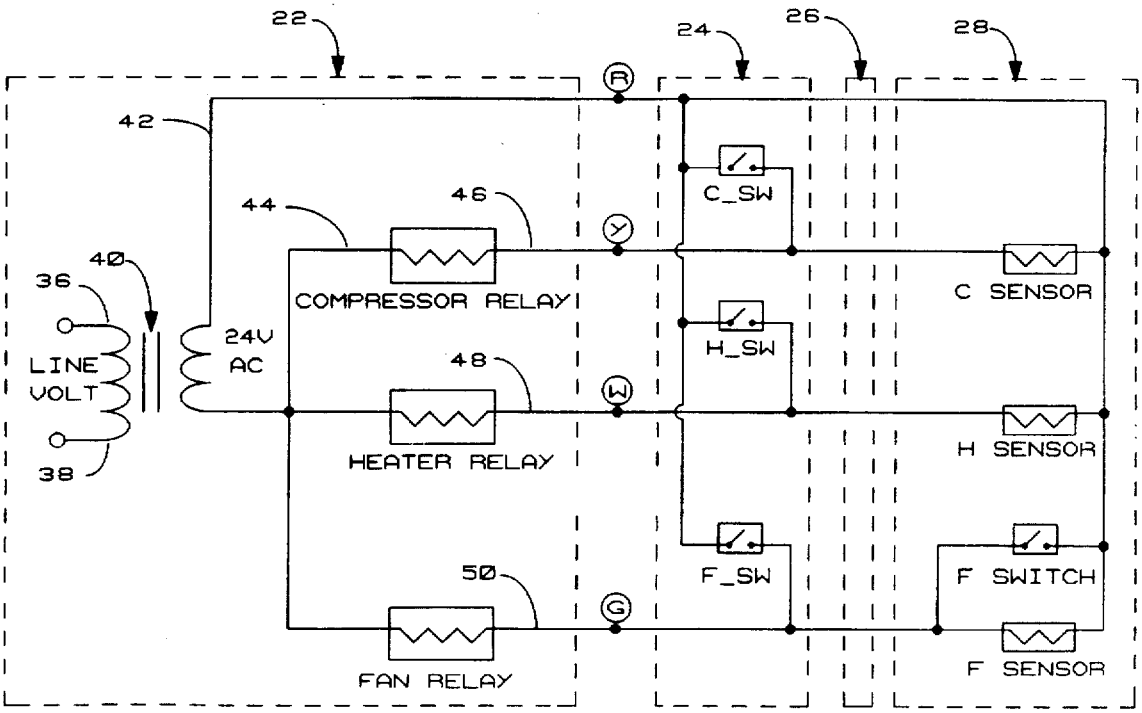
FIG. 2 shows an electrical equivalent interrelating the unit, an existing thermostat and an existing air conditioning system.

Power supply 60:

Referring to FIG. 2, when the air conditioning system is on, LINE VOLT across points 36 and 38 is typically 240 VAC 60 Hz, that is 240 alternating current root mean square volts oscillating at 60 cycles per second. When this happens, transformer 40 energizes the secondary points with 24 VAC at points 42 and 44. This power supply 60 provides continuous operation of the unit 28 when either independent inputs 42 or 44 are energized, as is always the case unless the LINE VOLT which energizes system 22 is off.

The COMPRESSOR RELAY acts as a low resistance, say 50 ohms, and the C SENSOR acts as a high resistance in the 10 kilo ohms range thus permitting the flow of small currents, in the order of a few milliamps, from point 46 to point 42, while the C_SW remains open. Also the C SENSOR has all the 24 VAC across it and point 46 can be said to be energized. Point 46 will only be de-energized when the LINE VOLT points drop to zero from a power failure or when C_SW switch closes.

The HEATER RELAY acts as the same way as the compressor relay but refers to the H SENSOR, point 48 and the H_SW switch.

With these two points, 46 and 48 with respect to 42, a voltage close to the 24 VAC is developed across the unit 28 for the raw supply, with the self imposed limitation of current levels in the order of a few milliamps.

Figure 3:
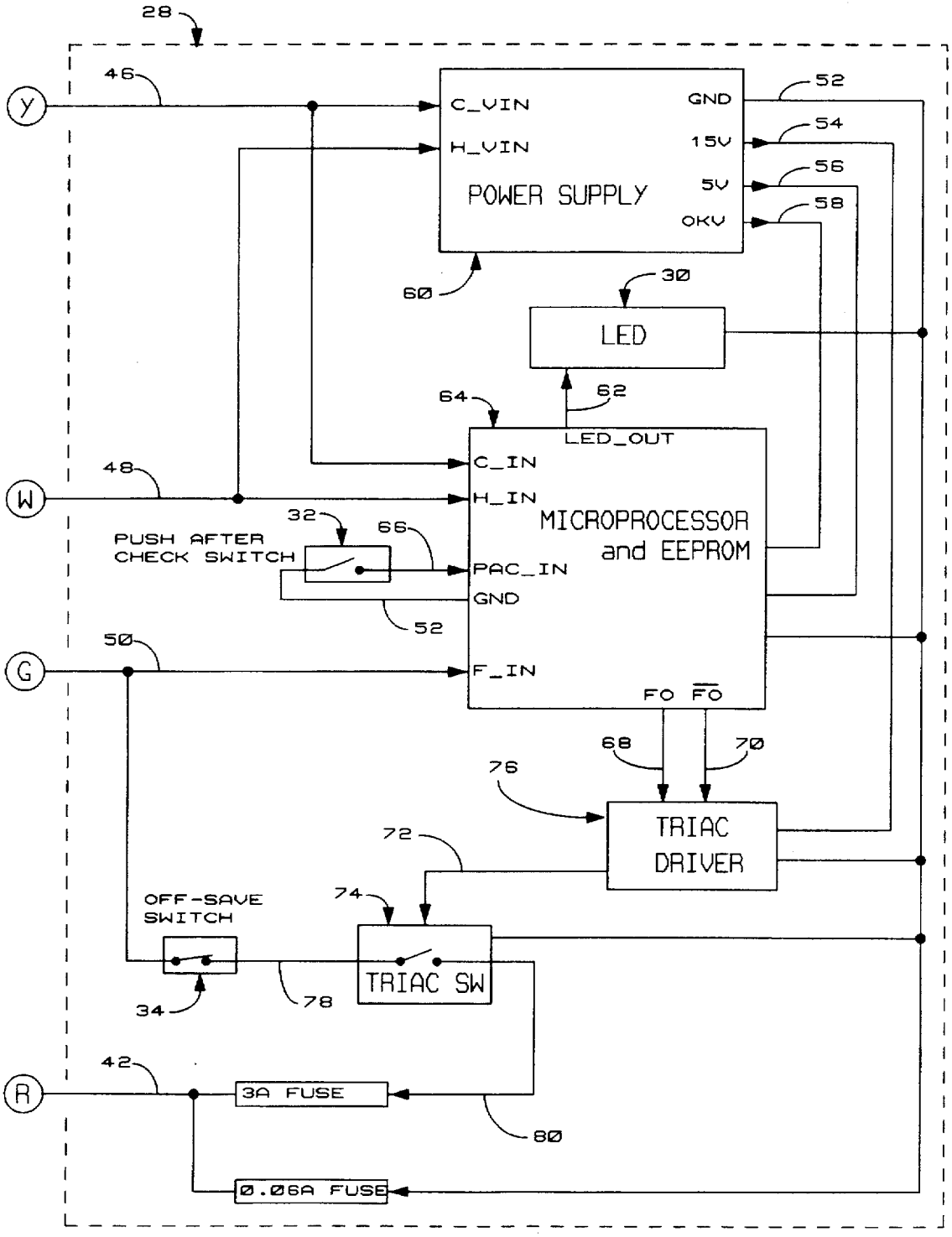
FIG. 3 shows the electrical block diagram of the preferred embodiment of the invention, the unit.

Referring to FIG. 3, the power supply 60 provides the unit 28 with the ground 52 reference, which is at the same potential as point 42 but with a protection fuse; regulated positive 15 volts direct current voltage 54 with respect to ground; regulated positive 5 volts direct current voltage 56 with respect to ground; and a signal OKV 58 to indicate voltage inputs are properly energized, that is either C_VIN 46 or H_VIN 48 is energized, and to reset the microprocessor 64 if both are de-energized.

Led 30:

This is a high efficiency light emitting diode that uses typically only 2 milliamps to produce a bright light. It is driven directly by a standard microprocessor output pin 62 and has a series resistor to limit the current.

Microprocessor and EEPROM 64:

This microprocessor system 64 comprises a standard microprocessor integrated circuit using an external serial EEPROM integrated circuit, EEPROM stands for electrically erasable programmable read only memory, to store the accumulated FAN on times. This special memory does not require any kind of power to hold its latest contents for over 40 years. Currently there are versions of the microprocessor we used that incorporates this kind of memory inside the microprocessor integrated circuit. The microprocessor 64 runs with a 32 kilo cycle per second crystal to conserve power, consuming only 0.040 milliamps. The firmware or permanent program memory is inside the microprocessor 64 as well as the internal temporary memory needed for the detailed operations.

Referring to FIG. 3, the C_IN 46, H_IN 48, PAC_IN 66 and F_IN 50 are digital inputs to the microprocessor 64, that is, after conditioning the signals, they present a logical 1 or 0 to the microprocessor integrated circuit.

In the same FIG. 3, FO 68 and ~FO 70 are direct outputs from the microprocessor 64 and are complementary outputs to the TRIAC DRIVER. Both signals are used to prevent unwanted side effects in case of power down or other types of power failure. One has to be logical 1 and the other logical 0 to activate the TRIAC DRIVER 76 to close the TRIAC SW 74 switch.

The LED_OUT is a direct output pin from the microprocessor used to turn on and off a LED 30.

The microprocessor receives power thru points 52, 56 and a reset signal from point 58.

Triac driver 76:

Referring to FIG. 3, when inputs 68 and 70 corresponds to logical 1 and 0 respectively, the output 72 is a square wave of 0 to 15 volts, with respect to ground 52, at approximately 5 kilo cycles per second. The output is inactive at any other input combination and will remain high at 15 volts when inactive.

Figure 4:
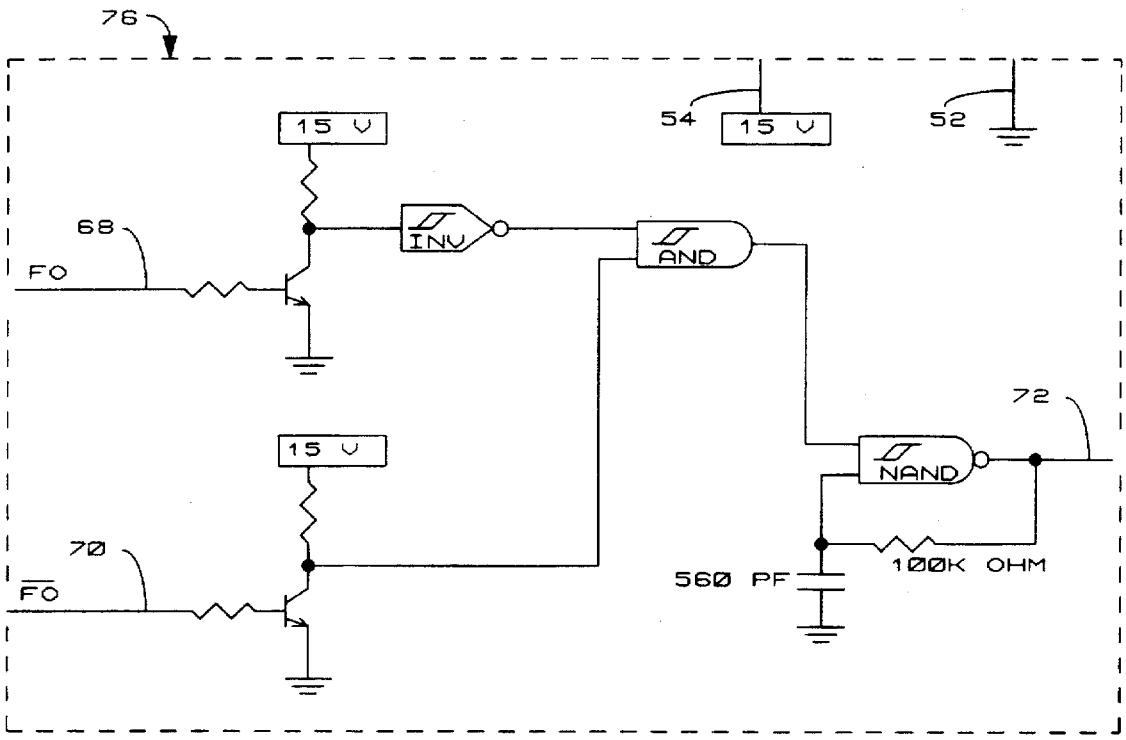
FIG. 4 shows the block circuit of TRIAC DRIVER, part of the unit.

FIG. 4 shows the block circuit of TRIAC DRIVER 76, the values 100 kilo ohm and 560 pico farad are for a nominal 5 kilo cycle per second square wave. All the logic gates are SCHMITT TRIGGER CMOS type, that is complementary metal oxide semiconductor technology with hysteresis inputs; they are powered by the 15V supply.

Triac switch 74:

Referring to FIG. 3, the only input control is the signal 72 that comes from the TRIAC DRIVER. The TRIAC SW will close only if a 5 kilo cycle square wave signal of 0 to 15 volts comes from point 72. Closing this switch 74 while the OFF-SAVE switch 34 is closed in the SAVE position is equivalent to closing the F SWITCH in FIG. 2

This switch 74 couples the signal 72 with two capacitors to turn on two small metal oxide semiconductor field effect transistors to in turn, turn on a regular triac semiconductor device that ultimately does the electronic function of closing the switch 74.

FIG. 5 shows the block circuit of TRIAC SW 74. The purpose of the 5 KHZ TO DC block is to turn on both n channel mosfet transistors by producing a direct current positive voltage at each G with respect to S when the 5 kilo cycle per second square wave is present. When both mosfets are on, the triac turns on connecting points 78 to 80, thus closing the switch 74.

Fuses:

Referring to FIG. 3, there are two optional fuses for protection. One for power at points 42,80 to turn on the fan relay and the other for all the signals at points 42, 52 of the unit 28. When fuses are intact, points 42, 52 and 80 are at the same ground potential for all intended purposes on this patent.

OPERATION—FIGS. 1 TO 3

These operation descriptions of the preferred embodiment of our invention are for the purposes of illustration, but not of limitation, in connection with the accompanied figures in which like numbers refer to like parts throughout and in connection to the description of FIGS. 1 to 5 set forth before.

Existing thermostat 24:

This thermostat can be mechanical or electronic, both having a STANDARD, FAN ONLY and OFF modes of operation.

In the STANDARD mode, the thermostat is set to AUTO, COLD or HEAT sub mode, and a the temperature previously selected is maintain within a few degrees.

In the FAN ONLY mode the thermostat is set to FAN and the fan turns on independent of any other settings.

In the OFF mode the thermostat is set to OFF causing the C_SW and H_SW switches in FIG. 2 to remain open, thus preventing the compressor and the heater to turn on.

STANDARD operation with the unit 28:

Referring to FIG. 2, for COLD sub mode, when the temperature rises above the set value, the thermostat 24 closes C_SW and F_SW by causing point 42 to connect to points 46 and 50, thus turning on the COMPRESSOR and FAN RELAYS to activate their respective units inside the air conditioning system. The unit 28 gets it power from point 48 and the unit's ground 42; this is possible because only the HEATER or the COMPRESSOR RELAY works at any given time, but not both.

At this time the unit 28 senses point 46 with the C SENSOR and finds this to be ground 42; it knows C_SW has being closed, it then closes the F SWITCH at points 50 and 42 keeping on the FAN RELAY. This RELAY was already on by F_SW being closed, the point of closing the F SWITCH is to have a smooth transition when extended operation takes place.

When temperature at the thermostat 24 reaches the selected value minus hysteresis, the thermostat turns off the COMPRESSOR and FAN RELAYS simultaneously by opening C_SW and F_SW as shown in FIG. 2.

The unit 28 will sense the opening of C_SW at point 46 and will keep the F SWITCH close for up to 6 minutes more, extending the fan on time based on how long the C_SW was closed and only if switch 34 in FIG. 1 is in the SAVE position. This would result in a 10% savings for the COLD sub mode.

Referring to FIG. 2, for HEAT sub mode, when the temperature drops below the set value, the thermostat 24 closes H_SW and F_SW by causing point 42 to connect to points 48 and 50, thus turning on the HEATER and FAN RELAYS to activate their respective units inside the air conditioning system. The unit 28 gets it power from point 46 and the unit's ground 42.

At this time the unit 28 senses point 48 with the H SENSOR and finds this to be ground 42; it knows H_SW has being closed, it then closes the F SWITCH at points 50 and 42 keeping on the FAN RELAY.

When temperature at the thermostat 24 reaches the selected value plus hysteresis, the thermostat turns off the HEATER and FAN RELAYS simultaneously by opening H_SW and F_SW as shown in FIG. 2.

The unit 28 will sense the opening of H_SW at point 48 and will keep the F SWITCH close for up to 30 seconds more, based on how long the H_SW was closed, and only will extend the fan operation if switch 34 is in the SAVE position. This would result in a smaller savings than in the COLD sub mode, but savings nevertheless.

In both, COLD and HEAT sub modes, the unit 28 accumulates the time the FAN is on when it senses the fan relay closure, point 50 to be the same as point 42, in FIGS. 2 and 3. While the fan relay is closed, the FAN is on and the air passes thru the filter, the microprocessor 64 accumulates this time every second and saves every hour the accumulated time in its non volatile memory called EEPROM. This memory is retained without batteries until the accumulated time in this and the FAN ONLY Operations reach a maximum of say 256 hours, at which time the CHECK FILTER LED 30 in FIG. 1 turns on indicating it time to check the filter. A few seconds later, the PUSH AFTER CHECK button 32 in FIG. 1 becomes active and thus responsive when pushed to clear the LED 30 after the user checks the filter.

This CHECK FILTER function has the greatest potential of all, it can save at least 20% and it works under any climates or conditions.

FAN ONLY operation with the unit 28:

The unit 28 only senses point 50 in FIG. 1 in this mode. It then accumulates the time the FAN is on as described in the STANDARD operation. If the change to FAN ONLY mode happen during an extending fan on cycle and if the unit 28 has switch 34 in FIG. 1 in the SAVE position, then the fan will continue to be on for up to 6 minutes unless cut off by switch 34 in the OFF position.

OFF Operation with the unit 28:

Referring to FIG. 2, the air conditioning system have the C_SW and the H_SW OPEN, irrespective of any other setting. The unit 28 will sense point 50 as in FAN ONLY operation. If the change to OFF mode happen during an extending fan on cycle and if the unit 28 has switch 34 in FIG. 1 in the SAVE position, then the fan will continue to be on for up to 6 minutes unless cut off by switch 34 in the OFF position.

Summary, Ramifications, and Scope

Accordingly, the reader will see that the unit can be easily install, it has a convenient small size and provides energy savings for the central air conditioning that takes into account the user preferences and allows for adaptation to climate regions.

In addition the unit has the following specific advantages

- totally maintenance free and automatic; does not require batteries, adjustments, very large capacitors or any other auxiliary power means
- simple indication of when to change the filter makes a difference in actual user behavior and provides a typical savings of more than 20% when user follows the indication
- when climate relative humidities are below 50%, an additional savings of 10% can be obtained by selecting the SAVE position on the unit
- easily disabled when maintenance of the central air conditioning is required
- low cost, pays itself with the typical savings of 3 months of operation
- adapts to user preferences by not having to change existing thermostat controllers Although the description above contains many specificities, these should not be construed as limiting the scope of the invention but as merely providing illustrations of some of the preferred embodiments of this invention. For example the only resistor and triac shown on FIG. 5 can be removed and point 80 will connect to point 82, this is possible by using higher power mosfets and diodes in the remaining circuit; the blinking LED indicator can be enhanced by adding a device that produces sound; the electronic components can be further integrated thus reducing size, etc.

Thus the scope of the invention should be determined by the appended claim and their legal equivalents, rather than by the examples given.

We claim:

1. An electronic attachment unit to an existing low voltage thermostat controller of a central air conditioning system, said unit comprising:

(a) a light to indicate when to change the air filter of said system, (b) a manual momentary switch to reset said light, (c) a manual switch option to extend the fan operation of said system when said thermostat controller is set in auto mode in either cool or heat thermostat selection, (d) an electrical power terminal R to connect to said existing thermostat that functions as common ground point for said unit, (e) an electrical compressor relay terminal Y to connect to said existing thermostat that functions as a sensor to determine the compressor relay on/off cycles and as one of two independent power source points for said unit, (f) an electrical heater relay terminal W to connect to said existing thermostat that functions as a sensor to determine the heater relay on/off cycles and as the other independent power source point for the unit, (g) an electrical fan relay terminal G to connect to said existing thermostat that functions as a sensor to accumulate the times the fan relay is on independent of any mode or setting and to determine after a predefined time when to turn on said light to change said filter, and as an automatic electronic switch to independently turn on the fan relay for a predetermined time after said auto mode has turned off said compressor relay or for another predetermined time after said auto mode has turned off said heater relay, in either case when said manual switch was set to said extended fan operation option, (h) a power module that uses said terminals R, Y and W to provide uninterrupted power to said unit, (i) a microprocessor system with the means to interpret said sensors, said manual switches, save said accumulated fan relay times permanently even under LINE POWER off condition of said system, turn on said light and when required turn on said electronic fan switch in the manner previously described; and (j) a printed circuit board and a small box enclosure to properly hold and place the electronic parts of said unit.

* * * * *